US005833777A

United States Patent [19]

Hanrahan et al.

[11] Patent Number: 5,833,777

[45] Date of Patent: Nov. 10, 1998

[54] BASE PLATE FOR SUSPENSION ASSEMBLY IN A HARD DISK DRIVE WITH A HARDENED FLANGE AND SOFT HUB

[75] Inventors: Kevin Hanrahan; Ryan Schmidt, both of Santa Barbara, Calif.

[73] Assignee: Intri-Plex Technologies, Inc., Goleta, Calif.

[21] Appl. No.: 931,802

[22] Filed: Sep. 16, 1997

[51] Int. Cl.[6] ..... C21D 8/02

[52] U.S. Cl. ..... 148/643; 148/714; 148/902

[58] Field of Search ..... 148/639, 643, 148/714, 902, 651

[56] References Cited

U.S. PATENT DOCUMENTS

| | | | |
|---|---|---|---|
| 3,972,744 | 8/1976 | Cantrell | 148/639 |
| 4,010,969 | 3/1977 | Cantrell et al. | 148/643 |
| 4,129,461 | 12/1978 | Rashid | 148/651 |
| 4,305,272 | 12/1981 | Johnson | 148/643 |
| 5,496,425 | 3/1996 | Gallagher | 148/651 |

*Primary Examiner*—George Wysomierski
*Attorney, Agent, or Firm*—Owen L. Lamb

[57] ABSTRACT

A base plate for a suspension assembly in a hard disk drive wherein the base plate has a hardened flange and soft hub. The base plate is stamped in a progressive die in a sequence of forging and coining operations. The base plate is subsequently fully annealed to allow the material to yield at a low stress level so that the hub will create a press fit against the inner wall of an actuator arm boss hole. The base plate is passed through a secondary coining operation following the annealing step to work-harden the flange portion only. The result is a base plate with a flange portion that is hardened and a hub portion that is softer than the flange portion. The advantage is that the hardened flange is more resistant to deformation of a load beam welded thereto and the hub is more disposed to plastically deform and harden during swaging which is desirable for maintaining a press fit.

5 Claims, 2 Drawing Sheets

BASE PLATE FOR SUSPENSION ASSEMBLY IN A HARD DISK DRIVE WITH A HARDENED FLANGE AND SOFT HUB

BACKGROUND OF THE INVENTION

1. Field of the Invention

This invention relates to disk head assemblies for supporting read/write heads adjacent rotating disks in disk drives and more particularly, to a base plate for attaching a load beam assembly to a head actuator arm.

2. Description of the Prior Art

Disk drives typically include a stack of spaced apart, concentric magnetic storage disks mounted on a common shaft, and an actuator arm assembly encased within a housing. The actuator arm assembly, also called a head stack assembly (HSA), comprises a plurality of arms extending into spacing between the disks. Mounted on the distal end of each arm is a resilient suspension assembly to which is attached an air bearing slider. Included in the suspension assembly is a load beam, which is mounted at one end to the actuator arm by means of a base plate, and a flexure which is attached to the other end of the load beam and pivotally supports the slider on a gimbal that keeps the slider suspended in a horizontal plane regardless of any motion of the load beam.

The load beam provides the resilient spring action that biases the slider toward the surface of a magnetic recording disk, while the flexure provides flexibility for the slider. A thin film magnetic transducer is deposited at an end of the slider to read or write on the magnetic disk.

The actuator arm and load beam elements of the head stack assembly are connected end to end by a base plate which includes a flat flange portion and a cylindrical hub portion or boss. In assembling the head stack, the hub is inserted into a load beam boss hole and the flange portion is welded to the load beam. The hub is then inserted into an actuator arm boss hole. Using a swage ball tool, pressure is applied to cause the hub to expand into the boss hole in the actuator arm, rigidly connecting the hub and attached load beam to the actuator arm boss hole. In the swaging process, a steel ball is pressed through the hub in the base plate. As the hub plastically deforms, it hardens, which is desirable for maintaining a press fit in the actuator arm boss hole.

A typical base plate is stamped in a progressive die in a sequence of forging and coining operations. The base plate is subsequently fully annealed to soften the metal which allows the material in the hub region to yield at a low stress level during a swaging operation. This permits more readily plastic deformation thus creating a greater press fit against the inner wall of the actuator arm boss hole. Since the flange as well as the hub is soft from annealing, the flange deforms easily. Deformations in the flange are transmitted to the load beam that is welded to the flange, causing undesirable fluctuations in the gram load. A prior art solution is to start with a harder base-plate material. But with a harder base-plate material, higher swaging forces are needed to cold work the hub, which in turn deforms the base plate even more severely. As the disk drive industry moves to nano and pico form factors, the effect of swaging on the load force is of even greater concern.

It is therefore an object of this invention is to provide a new method and means of manufacturing a base plate which will yield in the hub without excessive deformation of the flange.

SUMMARY OF THE INVENTION

The invention is a base plate comprising a flange portion that is hardened; and a hub portion that is softer than the flange portion. The method of manufacturing the base plate comprises steps of: A. stamping a hub from a sheet of metal in a first die operation resulting in a flange portion and a hub portion; B. annealing the flange portion and the hub portion to thereby soften the hub portion; and, C. stamping the flange to a specified flange thickness in a second die operation to thereby harden the flange portion only.

An advantage of this invention is that a hard flange of the base plate results in less gram load change for a given swage force, since the yield strength of the material is much higher and thus less likely to undergo plastic deformation.

A further advantage of this invention is that it provides the means by which to decrease the susceptibility of a flange region of a base plate to plastic deformation while not decreasing the hub region's susceptibility to work hardening during a swaging operation.

BRIEF DESCRIPTION OF THE DRAWINGS

The invention will be described in greater detail with reference to the drawings in which.

In these figures, similar numerals refer to similar elements in the drawing. It should be understood that the sizes of the different components in the figures may not be to scale, or in exact proportion, and are shown for visual clarity and for the purpose of explanation.

DETAILED DESCRIPTION OF THE INVENTION

Figure 1:
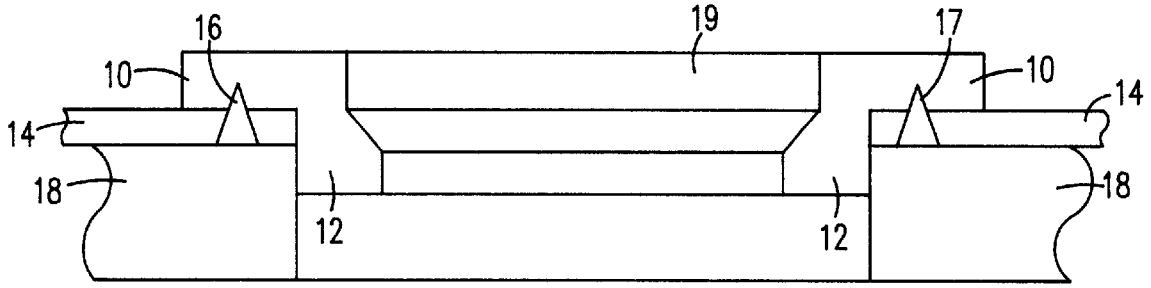
FIG. 1 PRIOR ART
FIG. 1 is side view of a base plate of the prior art.

FIG. 1 is side view of a base plate of the prior art. An actuator arm and load beam, which are elements of the actuator arm assembly, are connected end to end by the base plate. The base plate includes a flat flange portion 10 and a cylindrical hub portion or boss 12. In assembling the head suspension, the hub 12 is inserted into a load beam boss hole in a load beam 14 and the flange portion 10 of the base plate is welded 16 to the load beam. In assembling the head stack, the hub is inserted into an actuator arm boss hole in the actuator arm 18. A swage ball is passed through the center 19 of the hub 12 causing pressure to be applied to cause the hub 12 to expand into the boss hole in the actuator arm, rigidly connecting the hub and attached load beam to the actuator arm boss hole.

Figure 2A:
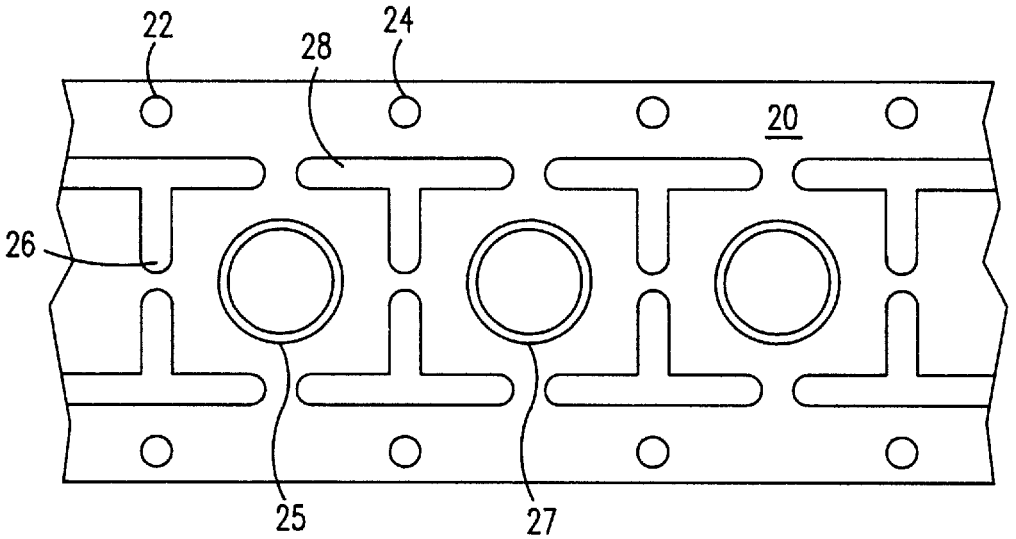
FIG. 2*a* and FIG. 2*b* illustrate the steps of manufacturing base plates in accordance with the present invention.
Figure 2B:
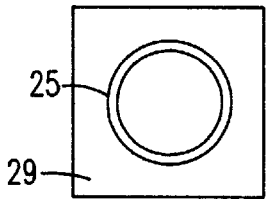

FIGS. 2*a* and 2*b* illustrate the steps of manufacturing base plates in accordance with the present invention. A sheet metal strip 20 is prepared with registration feed holes and clearance slots 26, 28. Hubs 25, 27, are stamped in a first die operation. The strip 20 is then fully annealed by heating the strip and precisely cooling it to harden the metal. Next the strip is stamped to a final flange thickness in a second die coining operation. Each base plate part is cut from the strip and deburred. Alternatively, the base plate parts are cut from the strip 20 and individual parts are annealed by heating the base plate part and precisely cooling it to harden the metal. Next the part is stamped to a final flange thickness in a second die coining operation. In either case, the result is a base plate with a thin, hardened flange 29 and a soft hub 25 as shown in FIG. 2*d*.

Methods of Manufacture

Figure 3:
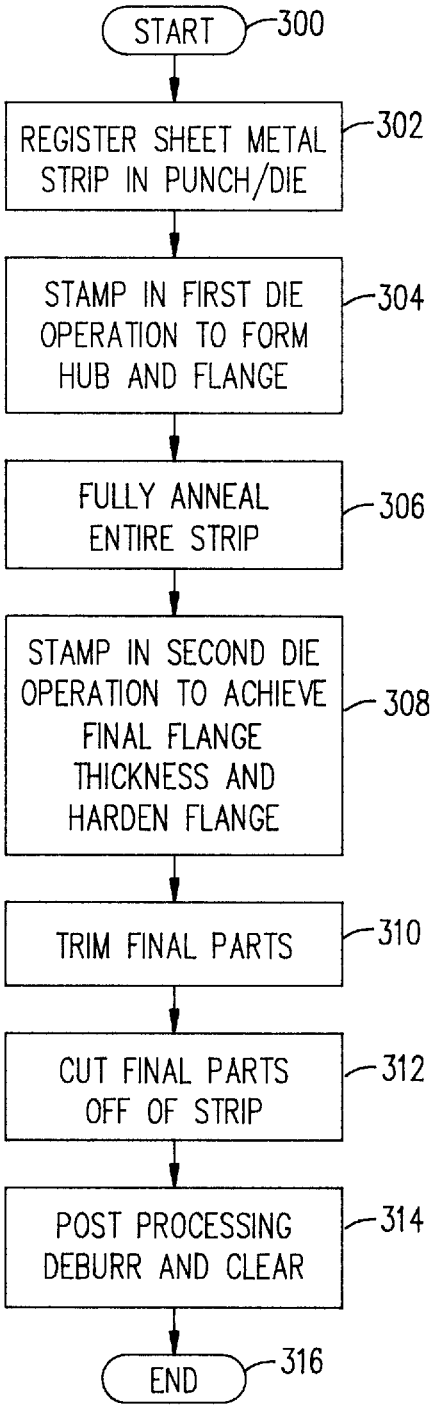
FIG. 3 is a flow diagram of the manufacturing steps in accordance with a first embodiment of the invention; and, FIG. 4 is a flow diagram of the manufacturing steps in accordance with a second embodiment of the invention.

FIG. 3 is a flow diagram of the manufacturing steps in accordance with a first embodiment present invention. The process starts 300 with the with the first step 302 which is to register a sheet metal strip in a punch/die machine. At step 304 the sheet is stamped in a first die operation to form the hub and flange. At step 306 the strip is fully annealed by heating the strip and precisely cooling it to soften the metal. The next step 308 is to stamp the strip is to a final flange thickness in a second die operation which hardens the flange but leaves the hub soft. The final base plate parts are trimmed, 310. At step 312 each base plate part is cut from the strip. For post processing, at step 314, the base plate parts are deburred and cleaned and the process ends 316.

Figure 4:
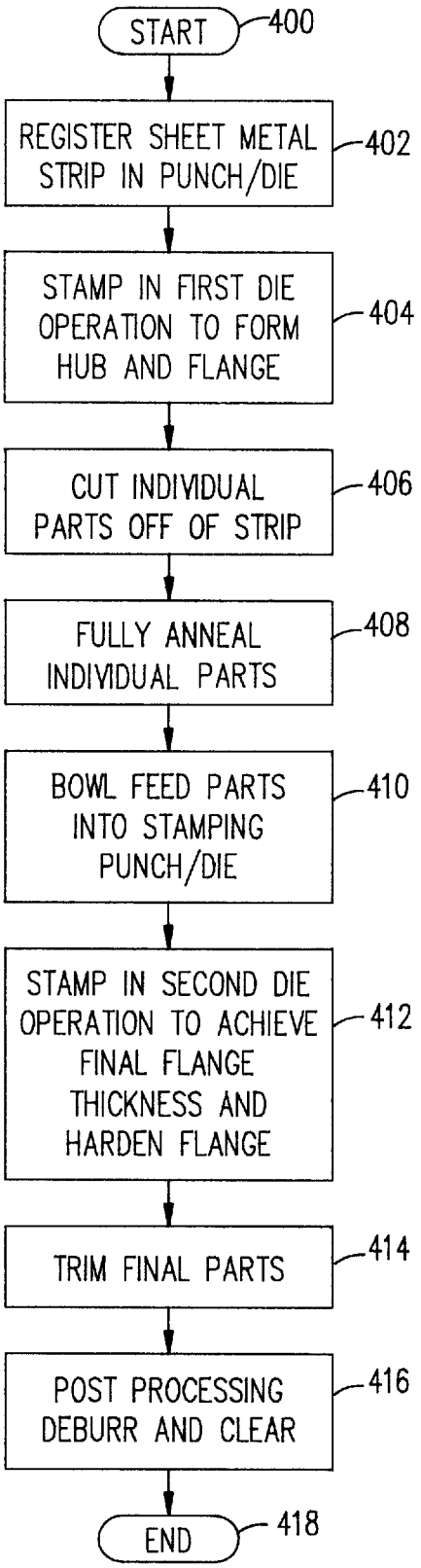

Refer to FIG. 4 which is a flow diagram of the manufacturing steps in accordance with a second embodiment of the invention. The process starts 400 with the first step 402 which is to register a sheet metal strip in a punch/die machine. At step 404 the sheet is stamped in a first die operation to form the hub and flange. At step 406 each base plate part is cut from the strip. At step 408 the individual parts are fully annealed by heating the part and precisely cooling it to soften the metal. The next step 410 is to bowl feed the parts into a stamping die. The next step 412 is to stamp the base plate part is to a final flange thickness in a second die operation which hardens the flange but leaves the hub soft. The final base plate part is trimmed, 414. For post processing, at step 416, the base plate parts are deburred and cleaned and the process ends 418.

While the invention has been particularly shown and described with reference to preferred embodiments thereof, it will be understood by those skilled in the art that the foregoing and other changes in form and detail may be made therein without departing from the scope of the invention.

What is claimed is:

1. A method of manufacturing a base plate comprising:

A. stamping a sheet of metal in a first die operation to form a flange portion and a hub portion;

B. annealing said flange portion and said hub portion resulting in a soft hub portion;

C. stamping said flange portion to a specified flange thickness in a second die operation resulting in a hardened flange portion; and, D. cutting a base plate from said sheet of metal subsequent to said stamping said flange portion.

2. A method of manufacturing a base plate comprising:

A. stamping a sheet of metal in a first die operation resulting in a flange portion and a hub portion;

B. cutting a base plate comprising said flange portion and said hub portion from said sheet of metal;

C. annealing said base plate to thereby soften said metal; and,

D. stamping said flange portion of said base plate to a specified flange thickness in a second die operation to thereby harden said flange portion only.

3. A method of manufacturing a base plate comprising:

A. stamping a sheet of metal in a first die operation to form a number of hub portions and a number of flange portions;

B. annealing said sheet of metal to thereby soften said metal, including said number of hub portions and said number of flange portions;

C. stamping said flange portions to a specified flange thickness in a second die operation resulting in hardened flange portions; and, D. cutting a base plate comprising one of said flange portions and a corresponding hub portion from said sheet of metal.

4. A method of manufacturing a base plate comprising:

A. stamping a sheet of metal in a first die operation to form a number of hub portions and number of flange portions;

B. cutting a base plate comprising one of said flange portions and a corresponding hub portion from said sheet of metal;

C. annealing said base plate to thereby soften said metal, including said hub portion and flange portion; and, D. stamping said flange portion of said base plate to a specified flange thickness in a second die operation resulting in hardened flange portion.

5. A method of manufacturing a base plate comprising:

A. stamping a sheet of metal in a first die operation to form a flange portion and a hub portion;

B. annealing said flange portion and said hub portion resulting in a soft hub portion;

C. stamping said flange portion to a specified flange thickness in a second die operation resulting in a hardened flange portion; and, D. cutting a base plate from said sheet of metal prior to said stamping said flange portion.

* * * * *